United States Patent [19]

Winkelried

[11] 4,077,546

[45] Mar. 7, 1978

[54] FOOT HEALTH AID APPLIANCE

[76] Inventor: Irwin Winkelried, 1 Beech Ter., Millburn, N.J. 07041

[21] Appl. No.: 730,802

[22] Filed: Oct. 8, 1976

[51] Int. Cl.[2] ..... B67D 5/06

[52] U.S. Cl. ..... 222/179

[58] Field of Search ..... 128/225, 260; 222/175, 222/179, 182, 61, 94; 251/295

[56] References Cited

U.S. PATENT DOCUMENTS

| | | | |
|---|---|---|---|
| 2,888,016 | 5/1959 | Delamater | 128/260 |
| 3,090,528 | 5/1963 | Ellis | 222/179 |

*Primary Examiner*—Robert B. Reeves
*Assistant Examiner*—Norman L. Stack, Jr.
*Attorney, Agent, or Firm*—Michael J. Ram

[57] ABSTRACT

The invention relates to a foot health appliance that consists of a box-like enclosure having a flexible or moveable platform mounted thereon. Attached to the top of the platform is a foot pad having toe spreading means. Mounted inside the enclosure is a pressurized container capable of releasing a medicated aerosol gas or liquid spray. The foot pad is operatively connected to the pressurized container so that a foot placed on the foot pad causes the spray to be released from the container.

9 Claims, 7 Drawing Figures

FOOT HEALTH AID APPLIANCE

The invention is directed to a foot health aid appliance of household or commercial variety that mechanically applies aerosol foot sprays. More specifically, it is directed to an appliance that properly positions and securely holds a disposable aerosol or pump type spray container for automatic application of aerosol anti-fungal, anti-persperant and deodorant foot sprays when mechanically activated by the foot.

According to the present invention, a foot health aid appliance is provided, within which an aerosol or pump type container can be placed so as not to be dislodged or accidentally removed when activated by the foot. Furthermore, said container is positioned in the appliance in a way to assure efficient use of their contents with automatic dispensing. In addition, the valve of the aerosol container or pump mechanism applies a spray to the foot only in an amount called for by action of the foot on mechanical levering means which is in contact with the said valve. Similarly, all spray application ceases upon release of the foot from the levering means which activated the container spray valve. The inherent recoil action of the aerosol spray valve or pumping mechanism, upon release of any mechanical leveraging action on it, immediately stops any spray application to the foot.

The device consists of a box-like enclosure which has a flexible or moveable open platform mounted in the top thereof. An aerosol spray container containing a medicated liquid or powder for treatment of the foot is removably positioned and mounted within the box frame in such a manner that activation of the aerosol mechanism causes the medicated material to be expelled through the open top of the box. The platform, when mounted on the enclosure, is mechanically connected to the spray container so that the pressure of a foot placed on the platform activates the spray mechanism. Upon removal of the foot from the platform the pressure and/or aerosol mechanism in the container automatically shuts off the spray. As an added design feature the platform has a foot pad, said pad having a raised portion near its forward end at a point just rear of where the toes would be placed and under the ball of a foot placed thereon. Upon the exertion of downward pressure of a foot placed on the footpad the raised portion pressing against the ball of the foot causes the toes to spread, thus allowing the medicated aerosol spray to reach into the area between the toes.

It is contemplated that the aerosol spray container can be either a sealed disposable pressurized spray container or a sealable, and refillable container having a mechanical pump for dispensing an aerosol spray or for pressurizing said container so that it will release a spray in the same manner as the sealed disposable, pressurized spray container.

Several patents cover methods of applying medication to feet. However, none of the devices shown in the prior art patents are adapted for insertion of a readily removable spray generating container. Several patents show systems for aerosol administration of liquids to feet but the mechanisms shown are cumbersome, complicated and do not have the ease of operation of the present invention. For example the unit shown in U.S. Pat. No. 2,025,936 to C. M. Clearman has a refillable liquid reservoir, a pump, motor, electrical switching, piping aerosol spray head and fluid recovery means.

This unit would be quite large and inconvenient to use and maintain. Also this unit has manual switching rather than a foot activated system.

Both of the patents to W. C. Rast, U.S. Pat. Nos. 2,267,169 and 2,274,739, cover devices which have air cylinders with pistons therein. Foot pressure on the treadles depresses the pistons causing a liquid to be ejected from the refillable liquid reservoir and to be squirted through the spray head onto the foot. To obtain continued spray action the user must rock back and forth on the treadles to allow the pistons to recharge.

The device shown in U.S. Pat. No. 2,988,754 to W. H. Mission has a pivot mounted pedal in contact with a bellows. A person stepping on the pedal depresses the bellows causing a premeasured amount of air to be forced through tubing aspirating liquid and expelling it as fine drops on the user's feet.

The device shown in U.S. Pat. No. 3,741,201 to Oudkerk uses an electrically driven pump to deliver medicated liquid from a reservoir to several nozzles positioned at different heights in respect to the foot.

The U.S. Patents to Swerdlow et al and Rich, U.S. Pat. Nos. 2,484,659 and 3,130,726 respectively, are directed to a means for "spraying" a powder. The Swerdlow et al device has a refillable flexible cup-like member positioned under the treadle member. Foot pressure on the treadle compresses the cup forcing powder through holes in the treadle. The Rice device operates generally in the same manner. The foot compresses a flexible liner forcing air and powder into contact with the foot.

Although the patent art shows several devices for spraying liquid foot medication, none of them could function to deliver an aerosol powder. In contrast, the powder delivery devices operate in a completely different mode. In addition, all of the prior art, whether for applying powder or liquid, necessitate messy filling operations and none would be adaptable to the use of self contained, disposable aerosol dispensers or pump type spray containers.

Figure 1:
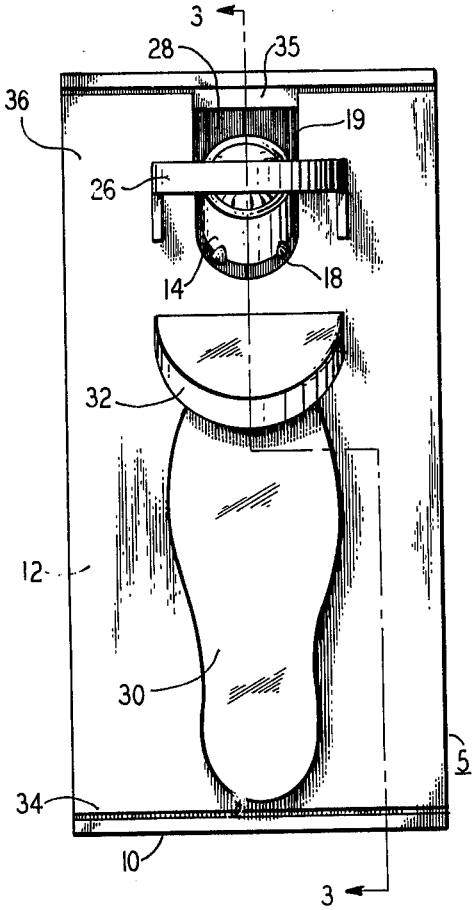
FIG. 1 is a top view of an aerosol spray applicator embodying the present invention.
Figure 2:
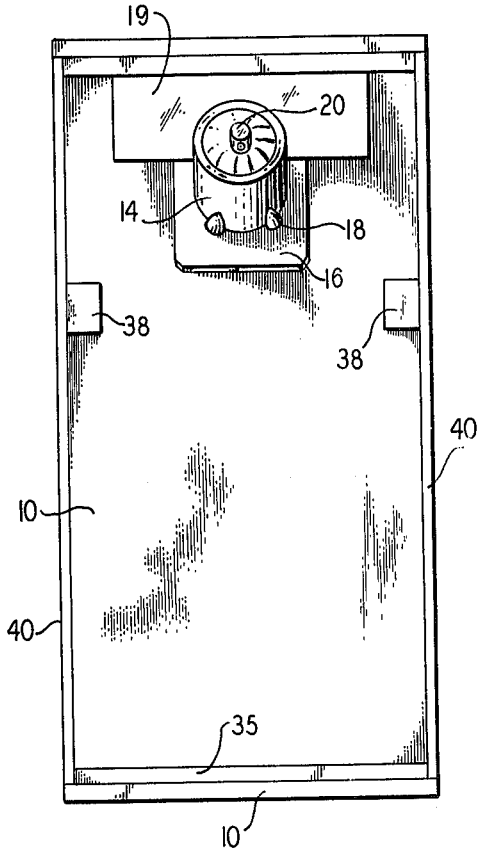
FIG. 2 is a top view of the aerosol spray applicator of FIG. 1 with the cover plate removed.
Figure 3:
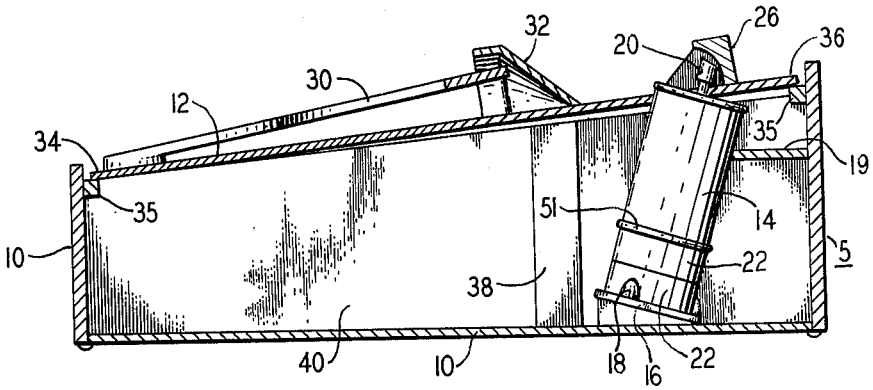
FIG. 3 is a cross section view taken along line 3—3 of FIG. 1.

The aerosol spray applicator 5 as shown in FIGS. 1–3 consists of an enclosure or box 10, a cover plate 12, an aerosol spray container 14 locating in the box and means for causing a spray to be released from the container 14. The box 10, generally rectangular in shape, has means in one end for supporting or holding the spray container 14 consisting of a tilt plate 16 on the base of the box with adjustable container clips 18 positioned thereon and an anti-shift bar 19 along the end wall of the box. A container 14 placed on the plate 16 is held by the clips 18 and prevented from shifting from its desired position by the anti-shift bar 19. The plate 16 may be tilted at an angle to the base so that the spray head 20 on the container 14 is pointed generally in the direction of toes of a foot placed in the proper position, as described hereinafter, on the applicator 5. For example an angle of about 5° to 45°, preferably 10° to 35° may be used. If necessary the container may be elevated by placing spacers 22 between the container bottom 51 and the plate 16 so that the spray head 20 is properly located for activation by the spray activator 26.

The cover plate 12, sized to fit on the top of the box 10, has an opening 28 at one end which allows the top of the spray container 14, and particularly the spray head 20 to protrude therethrough. A foot pad 30, located on the cover plate 12 has a toe spreader 32 located at one end. The foot pad 30 is sized to approximate an average foot so that when a foot is placed on the pad 30 the portion of foot directly behind the toe or the ball of the foot rests on the spreader 32 and the toes are positioned in the path of a spray ejected from the spray head 20 located in the opening 28. As indicated above, the spray container 14 is positioned at an angle to the base of the box 10 by tilt plate 16. Cover plate 12 may be located at an angle to the base of the box 10 and the pad 30 and spreader 32 may additionally be positioned at an angle to the cover plate 12 or merely elevated therefrom, as long as the totality of the angles positions a spray released from the spray container so that it impinges on the area between the toes or along the bottom surface of a foot placed on the pad 30. It is preferred that the axis of the spray is about 70° to 110° to the bottom surface of the foot.

Attached to cover plate 12 and positioned over the top of the spray head 20 is a spray activator 26. The heel end 34 and the toe end 36 of the plate 12 rest on support bars 35 mounted on the box 10 and the spray activator 26 touches, or nearly touches the spray head 20. Placement of a foot on the cover plate causes the cover plate to bend or flex thus depressing the spray head 20 and releasing a medicated spray from the container 14. Removal of the foot from pad 30, or decrease of the pressure applied by the foot, allows flexible cover plate 12 to return to its normal straight position and causes spray activator 26 to move off of spray head 20 thereby shutting off the aerosol spray.

Alternately, the support bar 35 under the toe end 36 of the cover plate 12 can be eliminated, the heel end 34 of the cover plate 12 rests on the support bar 35 positioned thereunder and the spray activator 26 rests on the spray head 20, thus suspending the toe end 36 of the cover plate 12 above the box 10. The total weight of the cover plate 12, pad 30, spreader 32 and spray activator 26 is not sufficient to depress the spray head 20. However, placement of a foot on the pad 30 is sufficient to depress the spray head 20, thus causing an aerosol spray to be released from the spray container 14 through the spray head 20. Removal of the foot from pad 30, or decrease of the pressure applied by the foot, allows the normal action of the spray container to lift the cover plate 12, thus shutting off the spray. To prevent the spray head 20, from being broken by excessive downward movement of the plate 30, at least one side limit stop 38 is attached on the side wall 40 of the box 10. The top of the stop 38 is located a distance from the plate 12 equal to or slightly less than the full downward travel of the spray head 20 so that upon completing the desired amount of downward travel, further downward movement of the plate 12 is prevented.

Although the present embodiment is shown having only one spray container, two or more spray containers may be used as long as the spray head in each can is directed toward the location of toes on a foot placed on the pad. The aerosol spray container 14 of the invention is preferably a disposable prefilled, and pressurized aerosol spray container. However, any container having a spray head for dispensing aerosol sprays may be used, for example a closed container having a mechanical pump for pressurizing the container prior to use or a container having a pump generated spray.

Figure 4:
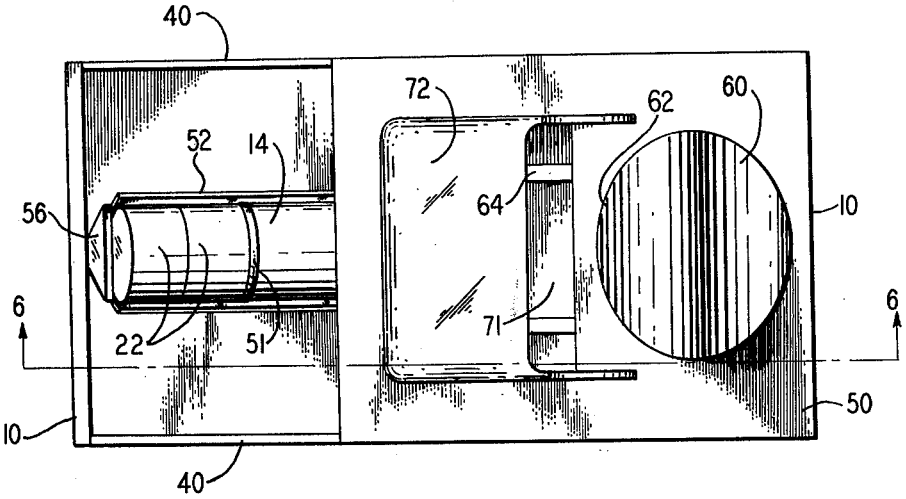
FIG. 4 is top view of a second embodiment of the aerosol spray applicator of the invention.
Figure 5:
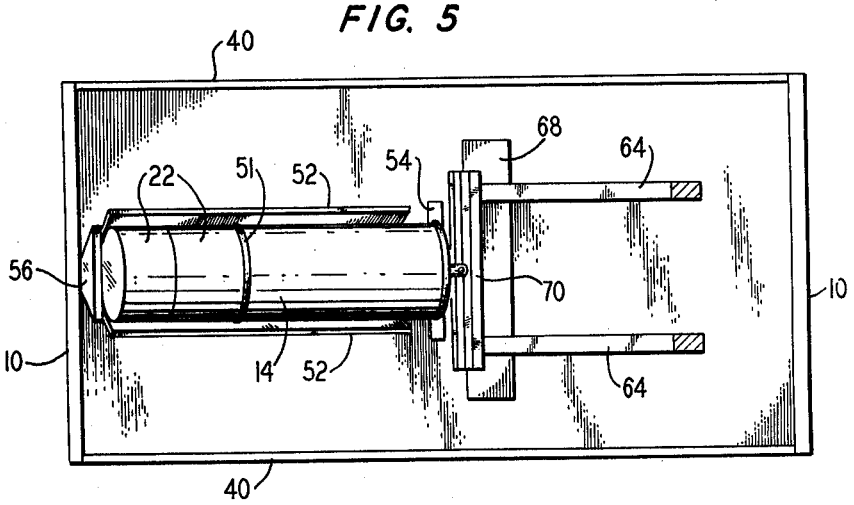
FIG. 5 is a top view of the applicator of FIG. 4 with the cover plate removed.
Figure 6:
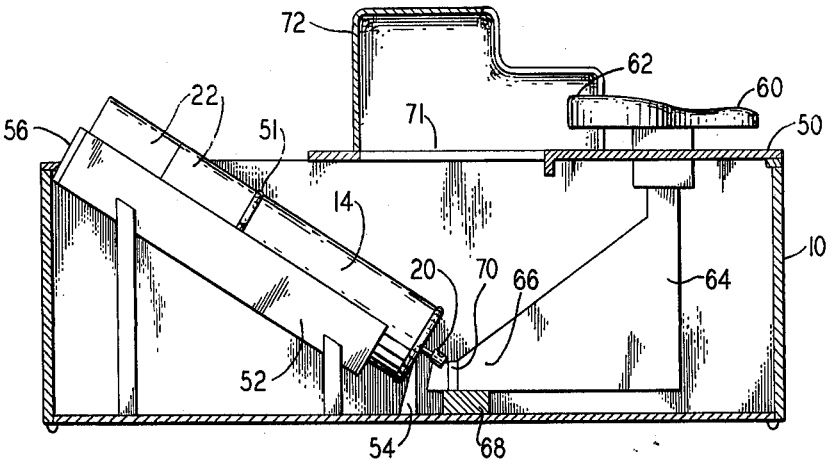
FIG. 6 is a cross sectional view taken along line 6—6 of FIG. 4.
Figure 7:
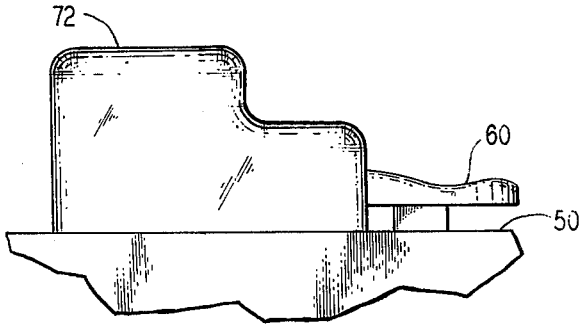
FIG. 7 is a partial side view of the embodiment of FIGS. 4–6 showing the spray hood and foot support plate.

FIGS. 4 through 6 show a second embodiment of the invention. Features of this embodiment which correspond with the embodiment of FIGS. 1–3 are numbered similarly. The second embodiment of the aerosol spray applicator consists of a box 10, having an integral top 50 an aerosol spray container 14 located in the box and means for causing a spray to be released from the container 14. At one end of the box is located a support trough 52 for holding the container 14 so that the spray head 20 on the top of the container 14 is positioned below the level of the container bottom. The top of the container rests against a wedge or wedges 54 attached to the bottom of the box 10 and the container is held immovable in the trough by a spacer or spacers 22 positioned between the container bottom 51 and the end plate 56 of the trough. Alternately, the spacers 22 can be forced against the container bottom 51 by springs (not shown) positioned between the end plate 56 and the spacer 22.

On the end of the box 10 opposite to the spray container 14 is a foot pad 60 movably and slidably mounted on the integral top 50. In the embodiment shown the food pad 60 has an up turned forward edge 62 which receives the ball of the foot and acts to spread the toe in the same manner as the toe spreader 32 of the first embodiment. Optionally the foot pad 30 and toe spreader 32 of the first embodiment can be used in the present embodiment. Mounted below the pad and extending into box 10 is a lever 64. The front end 66 of the lever 64 rests on a support 68. This support 68 insures that the pusher 70, which is part of the front end 66 of the lever 64, is slightly below the spray head 20 when the unit is not in use and that when the unit is in use an actuating pressure is transmitted directly to the spray head.

Located in the top 50 adjacent to the upturned forward end 62 of the foot pad 60 and in line with the direction of spray of an aerosol container 14 mounted in the box 10 is an opening 71.

To use the aerosol spray applicator an aerosol container 14 is positioned in the trough 52 and secured against block 54 using one or more spacers 22 depending on the size of the container 14. The spray head 20 is positioned so that a spray eminating therefrom will pass through opening 71. A person then places his foot on the foot pad 60 with the toes extending past the upturned forward edge 62 and over the opening 71. Using the foot on the pad 60 said pad is pushed forward toward the opening 71 with the ball of the foot against the upturned forward end 62. This pressure on the edge 62 caused the toes to spread. Also, this action causes lever 64 to move forward exerting pressure on spray head 20 causing a spray to be released from container 14, said spray passing through opening 71 and contacting the spread toes located above said opening. Release of the forward pressure exerted by the foot relieves the pressure exerted on the spray head 20, thus shutting off the spray.

As an optional feature to either of the embodiments a hood 72 closed on three sides can be placed on the cover plate 12 or the top 50 so that it is in the path of spray eminating from the container 14. As shown in FIGS. 4–7 the hood 72 has an opening on the side facing the foot pad 60 so that a foot can readily be placed in the proper position. The hood 72 acts as a shield and prevents excess spray which is not deposited on the foot from spreading into the surrounding area.

Accordingly, provided herein is a foot health aid appliance used to apply medicants from an aerosol or pumped container either powder or liquid, to a human foot, said appliance easily used by the applicant and said medicant easily and economically applied to the foot. Modifications from the embodiments described and shown herein may occur to those skilled in the art. Also it is clear that features of one embodiment can be readily incorporated into the other embodiment. All such modifications and interchange of features not departing from the spirit of the invention are intended to be a part of the present invention and embraced in the scope of the appended claims.

What is claimed is:

1. An apparatus for applying a medicated product, to a foot comprising:

an open topped box, at least one pressurized aerosol spray container containing a foot medication mounted in said box said container having an aerosol spray nozzle located therein for atomizing the foot medication and controlling the direction of said atomized medication, said spray container and valve further positioned to direct the medicated spray toward the opening in the top of the box, a moveable foot support plate positioned over and partly closing the opening of said box at a position above the aerosol spray container, a toe spreader mounted at the end of the foot support plate and in line with the medicated spray released from the aerosol container, and means connecting the foot support plate with the spray nozzle so that external force applied to said support plate causes the medicated spray to be released from the aerosol container.

2. The apparatus of claim 1 wherein the aerosol spray container contains a medicated foot powder.

3. The apparatus of claim 1 wherein the means connecting the foot support plate with the spray nozzle is a spray activator mounted on the foot support plate in contact with the aerosol spray nozzle so that pressure exerted on the foot support plate causes the medicated spray to be released from the aerosol spray container.

4. The apparatus of claim 1 wherein the means connecting the foot support plate with the spray nozzle is a lever mounted on the foot support plate and extending inside the box, said lever in contact with the spray head so that sliding pressure applied to the foot support plate causes the medicated spray to be released from the aerosol container.

5. The apparatus of claim 1 wherein the aerosol spray container contains a liquid medication.

6. A foot medication applications system comprising:

an open topped enclosure at least one medication spray container mounted in said enclosure, a foot supporting plate moveably positioned over the open top of the enclosure, wherein the foot supporting plate has a raised portion at one edge thereof which functions to spread the toes of a foot placed thereon, and a spray activator connected to said plate and in contact with the medication spray container so that pressure exerted on the foot supporting plate causes a medicated spray to be released from the spray container.

7. The foot medication application system of claim 6 wherein the medicated spray released from the spray container is a medicated aerosol powder.

8. The foot medication application system of claim 6 wherein the medicated spray released from the spray container is a medicated aerosol liquid.

9. The foot medication application system of claim 6 wherein the medication spray container has a spray head mounted therein, and the spray container is mounted in the enclosure so that the medicated spray released from the container is directed by the spray head toward the foot spreader.

* * * * *